United States Patent [19]

Ovitz, III et al.

[11] Patent Number: 4,783,017

[45] Date of Patent: Nov. 8, 1988

[54] CARPET RACK

[75] Inventors: Ernest G. Ovitz, III; Hubert D. Franks, both of Galva, Ill.

[73] Assignee: John H. Best & Sons, Galva, Ill.

[21] Appl. No.: 156,003

[22] Filed: Feb. 16, 1988

[51] Int. Cl.[4] ..... B65H 16/06; B65H 23/06

[52] U.S. Cl. ..... 242/55.3; 242/75.4; 242/86.52; 242/86.7; 242/156; 242/156.2; 188/83

[58] Field of Search ..... 242/86.5 R, 55.3, 55.2, 242/85, 86.52, 86.7, 99, 156, 156.2, 75.4, 75; 188/83, 67

[56] References Cited

U.S. PATENT DOCUMENTS

| | | | |
|---|---|---|---|
| 384,626 | 6/1888 | Hilleary et al. | 242/55.3 |
| 447,496 | 3/1891 | Slade | 242/156 |
| 671,576 | 4/1901 | Barnett | 242/55.3 |
| 838,517 | 12/1906 | Bowser | 242/55.3 |
| 985,060 | 2/1911 | Raabe | 242/55.3 |
| 1,638,236 | 8/1927 | Best | 242/55.3 |
| 2,135,540 | 11/1938 | Smith | 242/55.3 |
| 2,551,190 | 5/1951 | Walker | 242/55.3 |
| 2,565,644 | 8/1951 | Best | 242/55.3 |
| 2,601,560 | 6/1952 | Riemenschneider | 242/55.3 |

*Primary Examiner*—Stanley N. Gilreath
*Attorney, Agent, or Firm*—Kinzer, Plyer, Dorn, McEachran & Jambor

[57] ABSTRACT

Carpet display rack having notched uprights in which spindle assemblies are rotatably mounted, the notches being radiused for easy entry and facile rotation of the spindle assemblies. The spindle assemblies include end pintles on which stop washers (for braking) are mounted and support washers which support a core tube. The brake is handle-operated and includes a brake plate pivoting on one of the uprights to engage a rotating stop washer.

5 Claims, 2 Drawing Sheets

CARPET RACK

FIELD OF THE INVENTION

This invention relates to carpet roll supports or so-called racks on which heavy carpeting may we wound in a large supply, lengths being pulled out from time to time for display, or measured for customer sale. The term "carpet" or "carpeting" covers not only carpets in the usual sense, but other forms of floor covering which may be wound, such as linoleum, thin vinyl and the like.

BACKGROUND OF THE INVENTION AND THE OBJECTIVES

Display or support racks for carpet samples have heretofore been constructed with large and expensive castings, especially in instances where a lock of one form or another has been provided to secure the wound sample against accidental unrolling. U.S. Pat. No. 2,565,644 of Leon H. Best is a good example, as well as U.S. Pat. No. 2,565,645 by the same inventor.

Less complicated structures in the form of notched uprights have also been prevalent in years past. Johannson U.S. Pat. No. 1,637,573 is a good example; other examples are Hilleary et al U.S. Pat. No. 384,626 (1888); Holleman U.S. Pat. No. 1,922,892 (1933) and Smith 2,135,540 (1938).

One of the current manufacturers also makes provision for a so-called friction lock mechanism by which the end of a threaded bolt, mounted in the upright, may be turned inward to apply a resisting force to the rotating end portion of the spindle. The arrangement, after a period of use, tends to wear finish off the painted surfaces and will wear a groove in the rotating end of the spindle.

In view of the foregoing, one of the objects of the present invention is to construct a more sturdy and dependable spindle than heretofore; to radius the notches of the upright to assure easy entry of the spindles; to eliminate the need for a heavy casting to support spindle locks while at the same time making provision for both a lock and a brake, the brake having a mechanical advantage for effective operation; to employ washers on the spindles as supports, stops and brake surfaces; to employ hex-shaped bar stock to facilitate achievement of the foregoing; and to construct a brake of such form that it may be easily mounted and easily operated.

THE DRAWING

THE PREFERRED EMBODIMENT

Figure 1:
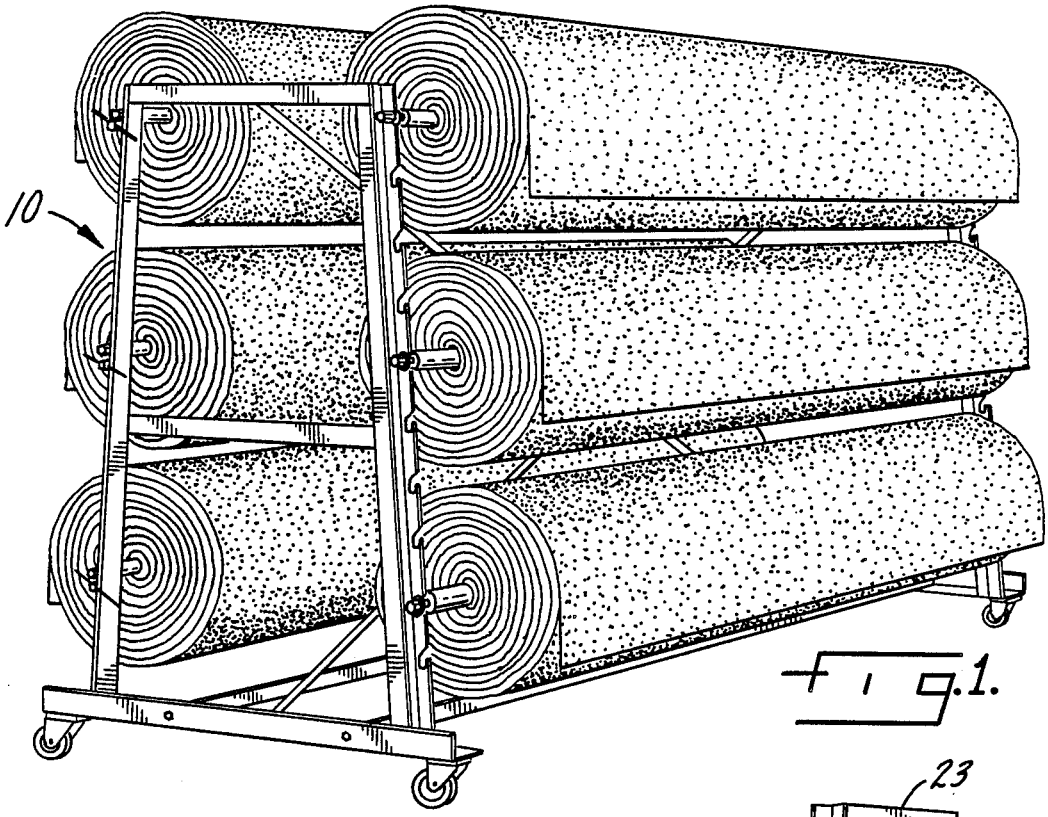
FIG. 1 is a perspective view of a carpet roll stand showing rolled carpets mounted thereon.
Figure 2:
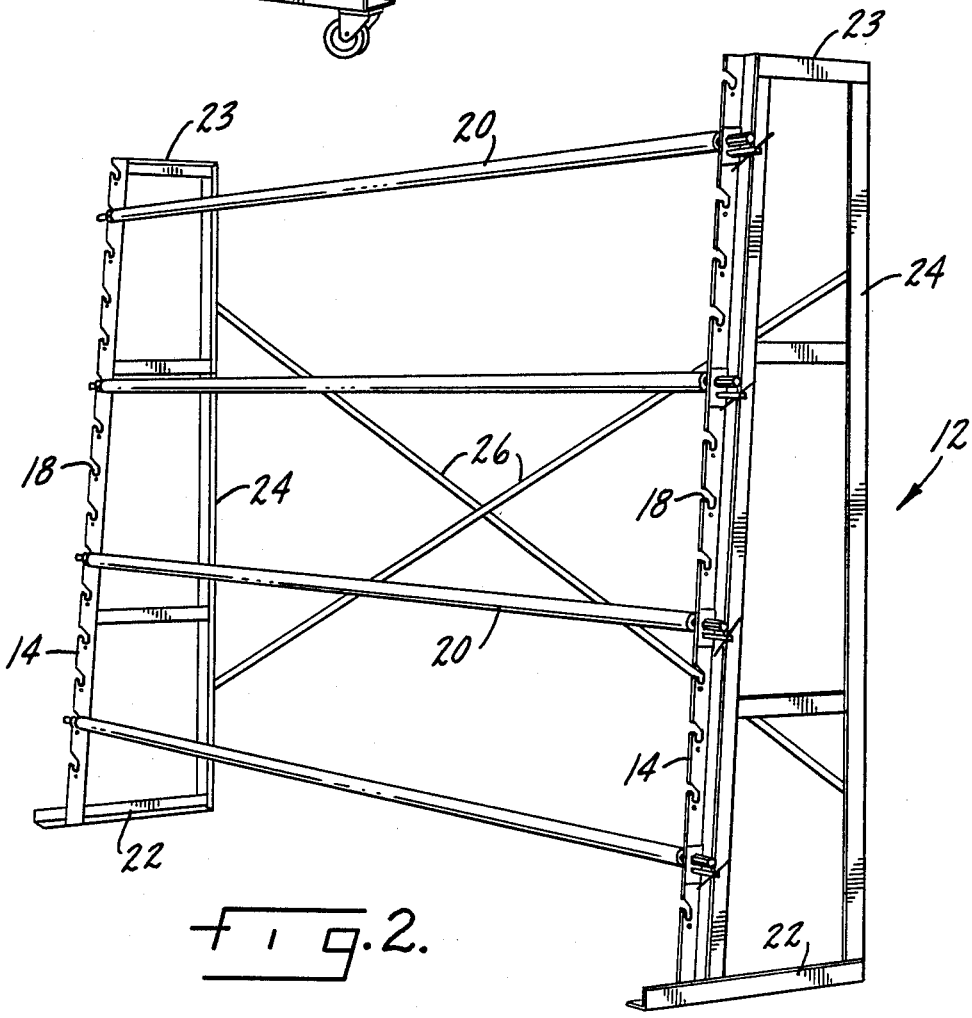
FIG. 2 is a view of another stand without the rolled carpets.

The two carpet display racks shown in FIGS. 1 and 2 are for illustrative purposes only, FIG. 1 showing a rack 10 with six rolls of supported carpeting while FIG. 2 shows a rack 12 of different proportions and geometry without the carpet rolls, four in number, mounted in position.

In any event, the racks are constructed to present at least a pair of opposed uprights 14, FIG. 2, each having a series of vertically spaced notches 18 in which spindle assemblies 20 are rotatably mounted. The notched uprights 14 have foot and head connectors 22 and 23 of one kind or another and a back brace 24 joined thereto. The back braces 24 are spaced and rigidly connected by cross bracing 26.

Again it is to be stressed that the manner in which the notched uprights are spaced and rigidly supported constitutes no part of the present invention and many different types of construction in this regard are possible as can be readily imagined by comparing the racks of FIGS. 1 and 2.

Figure 3:
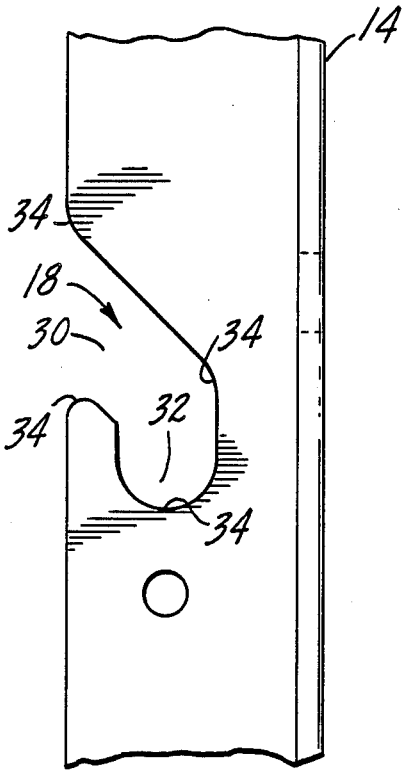
FIG. 3 is a partial view of one of the uprights, notched to accept the spindles.

A detail of one of the notched uprights 14 is shown in FIG. 3. Each upright is fabricated from a one-piece angle bar. The notches 18 have an entrance throat 30 and a communicating socket 32. The lips of the throat are radiused at 34 to facilitate entry of the end portion of each spindle as will be described in more detail below. The throat is angled inwardly and downwardly, leading to the socket, and the socket entry is also radiused so that the rounded portion of the spindle (hereinafter described in detail) will readily rotate therein.

Figure 4:
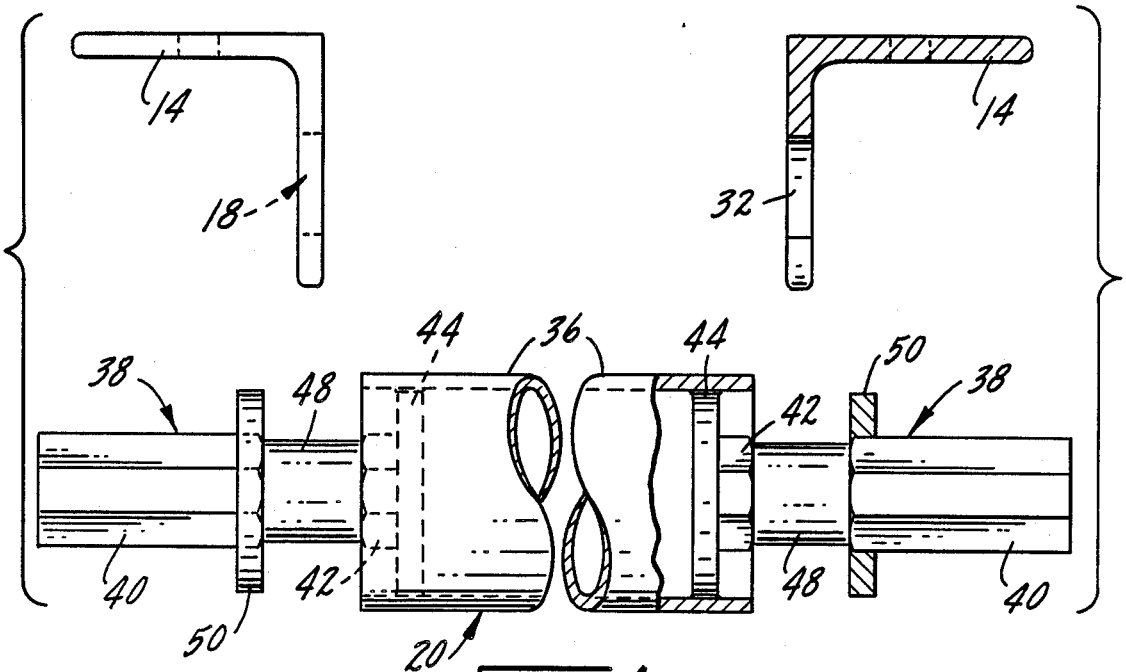
FIG. 4 is a view, partly sectioned, of the spindle assembly including the outer core tube.

A detail of each spindle assembly is shown in FIG. 4. The portion of the spindle assembly on which the carpeting is wound and supported is a long core tube 36. This portion of the spindle, the core tube, extends between the uprights as may be readily imagined from FIG. 2. Each end of the core tube is mounted to and supported by a pintle 38 and each pintle is of strong, sturdy construction by which many different functions are achieved in addition to the plain fact that a considerable savings in the cost of construction is achieved.

Thus as shown in FIG. 4, each pintle is fabricated from a polygonal bar stock 40 which in the present instance is hexagonal in cross section. Each pintle has an inner end portion 42 of the original polygonal geometry and a large diameter support washer 44 is welded thereto or otherwise fixed in position on the inner end of the pintle to support the inner diameter of the related end of the core tube.

Outward of the support washer, the bar stock is turned to present a reduced, full round intermediate portion 48 and this intermediate portion is the part of the spindle assembly which rotatably rests in the related notch of an upright.

Outward of the reduced diameter portion 48, the original contour or geometry of the polygonal bar stock is once more retained. This retained portion, first of all, serves as a support for a stop washer 50 welded thereto in position immediately outward of the notch in the related one of the uprights. Consequently, when a spindle is supported by and between the notches in the uprights, the stop washers 50 prevent lateral displacement. The free end portion of each pintle outward of the stop washer presents flat surfaces for receiving the socket of a power winder (not shown) employed for winding and unwinding the heavy carpet rolls.

It will be seen from the foregoing that the hexagonal bar stock, or equivalent polygonal cross section, in addition to mating with a power winder, affords seats for the two washers, and the intermediate portion may be turned to a true round cross section for rotatable movement in the notches. The second or stop washer 50 not only prevents lateral displacement of a spindle but also constitutes a surface for an unusual form of brake under the present invention as will now be described.

Figure 5:
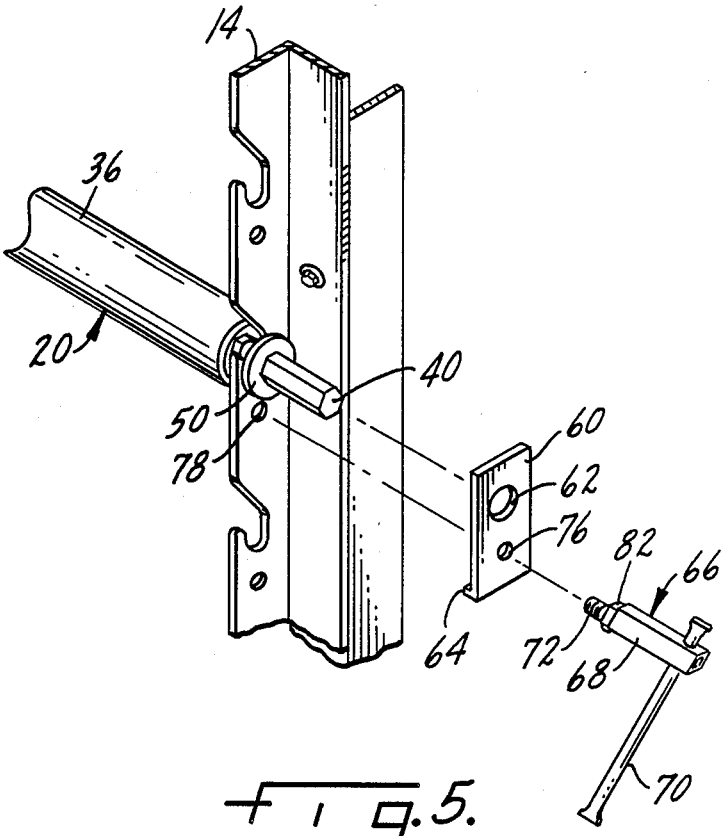
FIG. 5 is a fragmentary perspective showing an end of one of the spindles and the brake assembly associated therewith.

The carpet may be quite heavy and the torque therefore of high order during winding or unwinding. To oppose the torque a brake plate 60, FIG. 5, is employed in opposition to the rotating stop washer 50. The brake plate has a relatively large opening 62 which loosely fits the projecting outermost end of the pintle, the end portion outward of the stop washer 50. Thus, the brake plate normally hangs loose, suspended on the pintle end.

The brake plate has an inwardly projecting lip or flange 64 at its lower end, and by applying an inwardly directed force against the outer face of the brake plate 60, the lip 64 is brought into engagement with the upright and as further force is applied the brake plate forcefully engages, and opposes the torque of, the outer surface of the rotating stop washer 50.

To accomplish this a manually operating brake lever is afforded in the form of a turnkey 66. The turnkey assembly 66 includes a shank 68. The free or outer end of the shank 68 has a drilled passage and a loosely fitting handle 70 is inserted therein. The ends of the handle are swaged so that the handle cannot be displaced from the shank 68.

The inner end of the shank 68 is reduced in diameter and is threaded at 72. The threaded end of the shank 68 is adapted to fit freely in an opening 76 in the brake plate and the threaded portion 72 mates to a tapped opening 78 in the upright.

When the brake is to be applied, the shank 68 is rotated by the handle 70 until shoulder 82, separating the threaded portion 72 from the enlarged shank portion 68, bears against the rim area surrounding the opening 76. Further turning of the shank 68 now forces lip 64 against the outer face of the upright so that the lip becomes a pivot for the brake plate 60. Further turning or inward tightening of the shank 68 then causes the brake plate 60 to frictionally engage the rotating disc or washer 50 and this opposing force may be gradually increased until the spindle is brought to a stop. The brake plate in fact may be tightened to the extent where it actually locks the spindle against any rotary movement.

It will be seen from the foregoing that by employing "hex" bar stock, a sturdy spindle may be constructed having pintles with inner and outer end portions of polygonal cross section serving many different functions including support of the core tube, facile rotation, braking and adaptation to power winding. Also, the uprights may be mere one-piece angle bars, and both the upright and the outer stop washer may be combined with the brake plate and its lever into an efficient brake system of minimum parts. Hence, while the preferred embodiment of the invention has been disclosed it is to be understood that it is capable of variation and modification within the purview of the appended claims.

We claim:

1. A carpet display rack comprising a pair of laterally spaced uprights having opposed, aligned notches for receiving spindles on which carpeting may be wound and unwound, the spindles having end portions extended outward of the notches and provided with flats for receiving a socket of a carpet winder, each spindle end portion having a washer fixed thereon outward of the related notch to prevent lateral displacement of the spindle along a horizontal axis, a brake plate suspended loosely on one of the projected ends of one of the spindles outward of the related washer, the brake plate having an inwardly directed lip at the lower edge thereof engagable with the outer surface of the related upright, a hand-operated brake lever having a shank terminating in a threaded stud mounted in a tapped opening in the related upright whereby upon turning the shank inward, said lip is forced against the related upright and becomes a pivot whereby the brake plate, upon further inward turning of said shank, is brought into contact with the washer enabling spindle torque to be opposed as a length of the carpet material is wound or unwound.

2. A carpet display rack according to claim 1 in which the spindle includes a core tube positioned between the uprights and on which the carpeting is to be wound, and said spindle end portions include a pair of pintles, one secured to each end of the core tube, each pintle being fabricated from a length of hexagonal bar stock having an inner end within the tube to which a support washer is secured which is in turn secured to the inner diameter of the core tube, each pintle outward of the support washer being turned to reduced full round diameter reposing in the notch of a related upright, said stop washer being mounted on said pintle outward of said reduced full round diameter and each pintle outward of the stop washer retaining the hexagonal bar stock geometry forming said flats for receiving a socket of a carpet winder.

3. A carpet display rack according to claim 2 in which the uprights are one-piece angle bars and in which the notches have both a throat, angled inwardly and downwardly, and a downwardly extending socket, the throat being radiused to facilitate entry of the reduced portion of the pintle, and the socket entry being radiused to facilitate entry of the reduced diameter of the pintle into the socket.

4. A carpet display rack comprising uprights in which the ends of a carpet roll spindle are rotatably mounted, each end of said spindle having an end portion outwardly of the related upright and each said end portion having a stop washer thereon which rotates with the spindle when the carpet is wound or unwound, a brake plate suspended loosely on at least one end of the spindle outward of the stop washer and having an inwardly projecting lip engagable as a pivot with the related upright, a tapped opening in the upright and located above said lip, a brake lever for applying selected force to the brake plate by forcing it into engagement with the stop washer, said brake lever being in the form of a turnkey having a shank with a reduced inner end on which a screw thread fitting said tapped opening is formed, a handle on the shank for turning the screw in the tapped opening until the shank forces the lip of the brake plate into contact with the outer face of the upright whereby further turning of the screw causes the lock plate to pivot about the lip inward toward contact with the washer to apply thereto an opposing force during winding or unwinding of the carpeting.

5. A carpet display rack according to claim 4 in which the spindle includes a core tube and the spindle end portion include a pair of pintles, one at each end of the cart tube, each pintle being fabricated from polygonal bar stock to have polygonal inner and outer end portions and an intermediate portion turned true round, the uprights having notches in which the intermediate portions of the pintles are rotatably supported, the inner end portion of each pintle having a support washer fixed thereto and each support washer in turn supporting the inner diameter of a long core tube on which carpeting may be wound, the outer end of each pintle having said stop washer fixed thereto.

* * * * *